US005714200A

United States Patent [19]

Schlachter et al.

[11] Patent Number: 5,714,200

[45] Date of Patent: Feb. 3, 1998

[54] COATED, SAG-RESISTANT CEILING BOARDS

[75] Inventors: Bartholomew J. Schlachter, Lancaster; William H. Frantz, Elizabethtown, both of Pa.

[73] Assignee: Armstrong World Industries, Inc., Lancaster, Pa.

[21] Appl. No.: 625,245

[22] Filed: Apr. 1, 1996

[51] Int. Cl.[6] ..... B05D 1/00; B32B 5/16

[52] U.S. Cl. ..... 427/209; 427/407.1; 427/412; 428/240; 428/245; 428/262; 428/288; 428/327

[58] Field of Search ..... 428/240, 245, 428/262, 288, 327; 427/209, 407.1, 412

[56] References Cited

U.S. PATENT DOCUMENTS

| | | | |
|---|---|---|---|
| 3,804,706 | 4/1974 | Kurashige et al. | 162/109 |
| 3,856,562 | 12/1974 | White et al. | 117/140 |
| 3,954,540 | 5/1976 | Chamberlain, III | 156/253 |
| 4,066,805 | 1/1978 | Shenk | 427/226 |
| 4,611,445 | 9/1986 | Pressley | 52/144 |
| 4,695,507 | 9/1987 | Schwartz | 428/228 |
| 4,863,979 | 9/1989 | Beyersdorf et al. | 524/14 |
| 4,942,085 | 7/1990 | Guerro et al. | 428/288 |
| 5,013,598 | 5/1991 | Guerro et al. | 428/283 |
| 5,134,179 | 7/1992 | Felegi, Jr. et al. | 524/13 |

*Primary Examiner*—Randy Gulakowski

[57] ABSTRACT

For sag-resistant ceiling boards, a board has at least two coatings, one on the front face (coating A) of the board and at least one other coating (coating B) on the back face of the ceiling board. Both of these coatings must have an elastic modulus of at least about 400,000 psi to make the board rigid. In addition to this, coating B, on the back face of the board, must have a higher coefficient of humidity expansion than coating A of the front face.

12 Claims, No Drawings

COATED, SAG-RESISTANT CEILING BOARDS

BACKGROUND OF THE INVENTION

Field of the Invention

This invention relates to the coating of ceiling boards to make them more sag-resistant. Using the particular coating system that is described herein, ceiling boards can be made more sag-resistant.

Maintaining stiffness and rigidity of composite tile ceiling boards under high humidity conditions continues to be a problem for the ceiling tile industry. The problem is acute since the tiles and boards which are used in ceilings are supported only around their perimeters. Humidity weakens the tile and, due to the limited support around the perimeter, the tile unacceptably sags.

Previous attempts to solve this problem include the application of specific latex compositions to make the board more moisture resistant and have greater dimensional stability. U.S. Pat. No. 4,863,979 used polymeric latexes with relatively high glass transition temperatures to obtain a composite board that would not sag substantially in conditions of high temperature and humidity.

Other prior art methods which attempted to get sag-resistant ceiling boards included U.S. Pat. No. 4,942,085 which teaches a method which results in a reduced tendency to undergo humidity-induced sag. By this method, a coating composition which includes water, a filler and the reaction product of a glyoxal resin and starch is applied to at least one side of the particulate substrate.

Another reference which describes sag-resistant board is U.S. Pat. No. 5,134,179. According to this reference, a composition which combines a latex binder and extender particles on cellulosic newsprint fibers inside the board will sag less than 200 mils when exposed to high temperature and humidity.

In spite of such methods, however, ceiling boards and tiles continue to have sag problems, especially in high humidity (90% relative humidity or more). Some boards which are commercially available have a high modulus melamine-formaldehyde resin coating with a filler/binder ratio of 5/1 as a back coat in combination with a protein or starch under-coating on the board's front. The front coatings on such boards, however, have a low modulus. Such boards sag unacceptably when they are exposed to humidity.

Technology for further reducing ceiling board sag is highly desirable. It would be beneficial to have more sag-resistant ceiling boards. Accordingly, it is an object of the present invention to offer coated, sag-resistant ceiling boards. The specific front and back coatings on the board act together to improve the ceiling boards by giving them better sag resistance. A method to obtain a sag-resistant ceiling board by applying the coating system to a ceiling board is also provided.

SUMMARY OF THE INVENTION

The present invention calls for particular characteristics in coatings on the ceiling board. There must be at least two coatings, one on the front face (coating A) of the board and at least one other coating (coating B) on the back face of the ceiling board. Both of these coatings must have a high elastic modulus to make the board rigid. In addition to this, coating B, on the back face of the board, must have a higher coefficient of humidity expansion than coating A of the front face.

In the presence of humidity, when the greater coefficient of humidity expansion is in coating B on the back face, the board will curve away from the board's sag which is brought on by gravity and the humidity. This is true even if more than one coating is present on each face and even if coating A and coating B rest directly on another coating of the board instead of directly on the board's surface.

Coating B's higher coefficient of humidity expansion, combined with having an elastic modulus of at least about 400,000 psi in coating A and coating B on each face of the board results in a more sag resistant ceiling board.

A sag-resistant ceiling board comprises a ceiling board having a front face and having a back face, wherein the ceiling board has a coating system which includes coating A on the front face and coating B on the back face, wherein both coating A and coating B have an elastic modulus of at least about 400,000 pounds per square inch of coating cross-section thickness at relative humidities in the range of from about 90 to about 100%, and wherein further, coating B has a higher coefficient of humidity expansion than any coating on the front face of the ceiling board.

It is the front face of the board which, after the board is installed, faces an open, interior area of a building while the back face, after the board is installed, faces away from the interior area. The front face and the back face are opposed, flat surfaces. These two flat surfaces are parallel to each other and have perpendicular edges connecting them on four ends of the board.

DETAILED DESCRIPTION

With the present invention, at least two different coatings are required on the ceiling board. At least one coating on the front face (coating A) and at least one coating on the back face (coating B) is required to have a high modulus of elasticity (at least about 400,000 psi) even in high humidity. Coating B on the back face will also have a higher coefficient of humidity expansion than coating A on the front face.

Either coating A or coating B may be present on the board with other coatings. The same sag-resistant effect will be obtained even in the cases where coating A and coating B actually rest on another coating of the board. This is true as long as no coating is present on the front face of the board which has both: 1) a modulus of elasticity of at least about 250,000 psi and 2) a coefficient of humidity expansion which is equal to or greater than coating B's coefficient. Thus, other coatings of the front face can have the same or a higher coefficient of humidity expansion than coating B, as long as that coating (on the front face) also has a modulus of elasticity less than 250,000 psi.

Since the sag-resistant result is obtained even when either coating A, B, or both of them rest on top of other coatings of the board, the discussions herein include the cases where coatings A and B are really resting on other coatings on the board. Thus, such cases are included and for the purposes of the present discussion, all coatings are considered to be on the face of the ceiling board (or "on the board") even when one or more of them rests on another coating of the board. The coatings can also be described as being the prime coat on the board (the first coat) or the second coat on the board (resting on the prime coat) or the top coat on the board (the third coat resting on the second coat). Either coating A, coating B, or both of them can be the prime coat, resting directly on the board's surface, or they can rest on one or more coatings on the board (as the second or top coat), and sag-resistance will be obtained, although it is preferred to use coating A as the second coat, preferably the top coat is cosmetic.

With this combination of coatings, as atmospheric moisture increases, the coating with high humidity expansion will expand while the coating(s) on the front face will not expand as much. One or more coatings on the front face, in fact, may even contract. With the greater expansion of the coating on the back face, in high humidity the ceiling board will curve away from the plane of its front face. Since the ceiling board is installed face down, the result is that when humidity effects the board and its coating, the boards will tend to curve away from the direction of gravity. Together the coatings, therefore, cause a bending action that is in the opposite direction from the gravity-induced humidity sag which ceiling boards are prone to. This action will at least reduce the humidity sag of the ceiling board.

Preferably, the front face coating (coating A) should be selected to permit at the most only a limited, maximum expansion even in high humidity (90–100%) in addition to the high modulus. Whereas the back face coating (coating B) requires a positive amount of coating growth when exposed to humidity.

Coatings on the front face may be a combination of a prime coating to prepare the surface, an intermediate coating, and a cosmetic coating on the top to give the board a suitable appearance (normally white). If desired, a prime coating to prepare the surface of the back face can also be used. In fact, each of the board's faces can have multiple coatings.

In general, the thicker the coating, the more effective the coating is in obtaining the desired result in the board. For the effect of sag-resistance, both coating A and coating B should be a minimum of at least about 1 mil thick. Acceptably, however, coating A and coating B have a maximum thickness of 10 mils for reasons of practicality. The coatings are preferred to be in the range of from about 2 to about 8 mils thick, although they could be thicker if desired.

One of ordinary skill should realize that the coatings of the present invention can be applied to the boards and dried on the boards in the same manner as other prior art board coatings. The coating can, for example, be applied by such means as painting, dipping or spraying followed by oven drying. In addition to this, it is typical for boards to have acoustical and decorative features which interrupt the coating surface. Such features will not affect the performance of the coatings of the present invention.

The modulus of elasticity represents the ratio of stress/strain as the coating material is deformed under a load. The modulus of elasticity can also be understood to be the resistance to bending. A further explanation and a discussion of its measurement in coating materials is found hereinafter in the Examples section.

The coefficient of humidity expansion (which may also be referred to as the coefficient of hygroexpansion) is a number which indicates the change in length of a coating for a 1% change in relative humidity. Using this coefficient, the change in length of the coating can be found for any change in humidity. A discussion of the measurement of the coefficient can be found hereinafter in the Examples section.

Since the modulus of elasticity (also referred to as the elastic modulus) is required to be at least about 400,000 psi for coating A and coating B, even in a high humidity in the range of from about 90 to 100%, with the high modulus of elasticity each coating is stiff, and even at humidities in excess of about 90%, the coatings will tend to maintain rigidity in the board. This rigidity, provided by the high modulus of elasticity, will also oppose the sagging of the board.

Although the coating system of the present invention can be put on any ceiling board, of any formulation, to take advantage of the sag resistance offered herein, preferred formulations of ceiling boards can be used. A preferred board formulation which can be used is from about 15 to about 90% by weight of mineral wool, from about 3 to about 30% by weight of cellulosic fibers, from about 5 to about 15% by weight of a binder, and optionally perlite at an amount up to about 50% by weight.

In preferred embodiments, a sag-resistant ceiling board comprises a ceiling board having a coated front face and a coated back face, wherein the front face includes coating A and the back face includes coating B, wherein both coating A and coating B have an elastic modulus of at least about 400,000 pounds per square inch of coating cross-sectional area at relative humidities in the range of from about 90 to about 100%, and wherein further, coating A has a coefficient of humidity expansion up to a maximum of about 0.000008 inch/inch/% relative humidity and coating B has a coefficient of humidity expansion of at least about 0.000012 in/in/% RH (inch/inch/% relative humidity).

In other preferred embodiments, the coatings on the front face will have a coefficient of humidity expansion that is at least about 0.000003 in/in/% RH lower than coating B on the back face of the ceiling board.

Coatings which have an elastic modulus of at least about 400,000 PSI and which can be suitable for coating A on the front face includes highly crosslinked polymer coatings. For example, a crosslinked epoxy having a filler/binder ratio of about 7/1 or less. The filler/binder ratio of 7/1 or less is needed so that the epoxy coating will have the necessary minimum elastic modulus. Other coating materials which may also be suitable as coating A at appropriately low filler/binder ratios (about 7/1 or lower) are an acrylic with a Tg (glass transition temperature) greater than 40° C., and a urethane with a Tg greater than 40° C.

Suitable coating materials for coating B can be taken from any hydrophilic high modulus material. Suitably the coating material will have a carbyxyl or a hydroxyl functionality. This includes, for example, a phenol formaldehyde coating.

Preferred coatings (for coating B) which have both the high elastic modulus and a high coefficient of humidity expansion includes melamine formaldehyde having a filler/binder ratio of a maximum of 7/1 or less. Again, this maximum filler/binder ratio level has been found to be needed in order to give the coating the minimum needed elastic modulus.

From actual performance of the coatings on boards, it has been noted that the present invention gives better performance when coating A is the second coat on the ceiling board. For this preferred embodiment, any suitable coating material can be used to put down the prime (first) coat on the board. Such coatings include starch, protein, acrylic and latex. Most preferably, however, for the best sag-resistance performance, both the prime coat and the second coat on the board qualifies as coating A (both have a modulus of elasticity of 400,000 psi of coating and a coefficient of humidity expansion less than coating B which is on the back face of the board).

Such coatings are either commercially available or can be made by any of the known methods.

EXAMPLES

The present invention can be better understood by the examples which follow. All parts and percentages are by weight unless it is otherwise indicated.

ELASTIC MODULUS MEASUREMENTS

The elastic modulus for several coatings (indicated below) was measured using a Beam Bending Test in which a coated steel shim is deflected a measured amount and the load put on by this deflection is measured. The effect of the steel shim is accounted for and removed, and the elastic modulus for the coating is calculated. Advantageously, in such a test, the bending load greatly amplifies the reinforcing effect of the coating making it easier to detect the change in stiffness added by the coating.

Steel was selected as the substrate because: 1) the elastic modulus of the steel does not change with relative humidity, and 2) the coatings do not seep into the substrate, and 3) the steel is unaffected by the heating/drying process used to cure the coatings.

For the mathematical calculations, simple beam equations were used. Since basic beam equations cannot be applied directly to a beam that is made of more than one material, the technique known as the "method of transformed areas" was used to mathematically convert the composite beam into one made of a single material, but having a new cross sectional shape so that the overall stiffness remains the same. With this modification, basic beam equations can then be used to calculate the elastic modulus of the coating since, in the equations, the only unknown is the modulus of the coating.

Sample Preparation

Since most of the coatings do not wet out evenly on the steel shim surface, the surface of the shim is prepared so that it can be coated evenly. Shim surfaces were prepared by either sanding the shim surface with emery cloth or by etching it with nitric acid. Either of these methods can be used without effecting the result of the measurement. The thickness and modulus of the steel shim, however, is measured after surface preparation.

After the steel surface was prepared, the shims are cut into pieces that were 1.25×0.5 inches. The measurements (thickness) of each was individually measured for the calculation of the coating's elastic modulus. Before coating, the bare (uncoated) shim pieces were tested, and the elastic modulus of the steel was calculated for each sample. This established the baseline modulus of the steel for each sample.

The coatings were sprayed onto the steel surface of one side of the shim. Separate layers were sprayed, and then each layer was dried in an oven (at 300F.) for about 30 seconds to obtain tack before applying the next layer. After a thickness of approximately 8–10 mils was achieved, the shim samples were put back into an oven for final curing. Each coating was on one side of the shim only and was one inch long and centered on the 1.25 inch length of each shim. The coating reached from side to side of the 0.5 inch wide surface.

After coating, the samples were cooled and stored in a desiccator until tested for the data measurements of 1) sample deflection and 2) the amount of force put on the sample by the deflection.

Sample Measurement

A U-shaped anvil was used which had a 1.0 in. (inch) span. The coated shim samples were placed, coating side down, on the anvil. Each sample was supported at each end of the coated length by one side of the U-anvil.

On its bottom surface, the U-anvil was supported at one end by a pivot rod and at the other end by a Sensotec Model 13 sub-miniature button-style compression load cell which had a range of from 0 to 150 grams. This compression load cell was used to measure the load (amount of force) needed to obtain the measured deflection.

For the deflection measurement, a Starrett Micrometer head (having a non-rotating spindle) was placed at the center of the shim. Deflection was measured with the micrometer in units of 0.001 in.

On each side, the anvil put two equal, upward forces to the shim, while the micrometer head provided a downward force. This places the beam sample in "three point" bending. A linear strain distribution is assumed from beam theory. Stress distributions depend on the strains and elastic moduli of the layers.

Each sample was measured with the coating side down, which placed the coating layer in tension. The first reading on the micrometer was recorded as the zero deflection point. Then the micrometer head was lowered in 5 mil increments, and for each, the load on the cell was recorded after waiting about 10 seconds for the meter to stabilize.

Data readings were taken at several humidity levels. The data from the deflection measurements was then graphed, plotting X=deflection and Y=force. Based on the points obtained, a straight line was found and the slope of the line was determined and designated as K (stiffness).

Alogorithm for Determining the Elastic Modulus of One Layer in a Two Layered Composite Beam The basic beam equations indicated hereinafter were then used to calculate the elastic modulus of the coating. Using a back-calculation in an algorithm which is based on simple beam theory and the method of transformed areas, the elastic modulus of the coating layer in the two layer composite beam is obtained. Back-calculation is a familiar mathematical technique, and the simple beam theory and method of transformed areas are generally discussed in any introductory level college text book on mechanics or strength of materials (for example, Popov, E. P., "Mechanics of Materials", 2nd Edition, Prentice-Hall, 1976; and Timoshenko, S., "Strength of Materials", Vol. 1, Van Nostrand, 1955).

The calculation of elastic modulus is iterative (and involves back-calculation) since several intermediate variables required for the solution depend on the elastic modulus of the coating (which is not known a priori). The common approach taken to solve such problems involves making a "guess" at the possible elastic modulus, solving the equations, checking an error term, and then revising the guess value to reduce the error. This is repeated until the error term reaches some tolerance value, at which time, the system of equations is essentially satisfied and the latest estimate of coating elastic modulus is taken as the final value.

The following alogrithm is used:

(In practice this algorithm can be executed using commercially available software, such as for example, TKSolver produced by United Technical Systems (UTS), Inc.)

Step 1. Assume an initial guess value for the elastic modulus, $E_c$, of the coating layer.

Step 2. Based on the current estimated value for the coating elastic modulus, calculate the following geometric properties of the cross section. (The nomenclature definitions for all of the equations in the algorithm is given after Step 6 below.)

$W_c=W(E_c/E_{ref})$ $W_s=W(E_s/E_{ref})$ $A_c=W_c d_c$ $A_s=W_s d_s$ $I_c=W_c d_c^3/12$ $I_s=W_s d_s^3/12$ Step 3. Determine the location of the neutral bending axis by solution of the following equation.

$$X=(A_c d_c-A_s d_s)/2(A_c+A_s)$$

Step 4. Determine the second area moment of the composite cross section with respect to the location of the neutral axis by the following equation.

$$I_{eq}=I_c+A_c[(d_c/2)+|X|]^2+I_s+A_s[(d_s/2)-|X|]^2$$

Step 5. Determine the bending stiffness of the composite section by the following equation.

$$(F/d)_{guess}=48E_{ref}I_{eq}/L^3$$

Step 6. Compare this guess value with the value as determined by actual bend test measurements. If this value is not within some tolerance of matching the measured value, adjust the value of the coating elastic modulus and repeat the calculation from step 2 above. If this value is within tolerance, stop the algorithm and report this value of film modulus as the converged value. A comparison tolerance of 0.000001 was used.

Nomenclature

X is position of neutral bending axis with respect to neutral axis, [inches$^4$]

W is the width of the shim, [inches] (in)

$W_c$ is the adjusted width of the coating, [in]

$W_s$ is the adjusted width of the shim, [in]

$E_c$ is the elastic modulus of the coating, [pound foot/inch$^2$]

$E_s$ is the elastic modulus of shim, [pound foot/inch$^2$] (lbf/in$^2$)

$E_{ref}$ elastic modulus of reference material, [lbf/in$^2$]

$A_c$ is the cross sectional area of coating based on the adjusted width, [inches$^2$] (in$^2$)

$A_s$ is the cross sectional area of shim based on the adjusted width, (in$^2$)

$d_c$ is the thickness of the coating, [in]

$d_s$ is the thickness of the shim, [in]

$I_c$ is the local second area moment of the coating based on the adjusted width, [in$^4$]

$I_s$ is the local second area moment of the shim based on the adjusted width, [inches$^4$] (in$^4$)

$I_{eq}$ is the second area moment of the coating/shim composite with respect to the neutral axis, (in$^4$)

$(F/d)_{guess}$ is the stiffness of the composite beam based on the assumed coating modulus value, [lbf/in$^2$]

L is the length of the bending span, [in]

Since a single load cell was used to measure the load under just one end, the load reading is doubled to determine the actual centerpoint load on the sample.

Resulting Data

The result of the calculations is to give the elastic modulus measurement in units of pounds per square inch of the coating cross-sectional area at 90% relative humidity. The elastic modulus of the 8–10 mil thick coatings on the steel shims were measured using the above described three-point bending test under conditions of 90% humidity.

Using this described method, the values for elastic modulus which are given in Table 1 below were found.

It is interesting to note that the melamine-formaldehyde coating offered an opportunity to cross check the above method used for calculating elastic modulus. It was possible to obtain free films of the melamine-formaldehyde. These films were then bend tested without the support of a steel substrate. The results of these tests were almost identical to the results obtained from the coated steel shims.

COEFFICIENT OF HUMIDITY EXPANSION

Coatings of different materials change length, either expanding or contracting as the humidity increases. The coefficient of humidity expansion is a numerical factor which indicates the amount of change in length which can be expected per linear unit of the same coating material with the change in humidity. The coefficient can be either positive or negative since the coating length can either increase or decrease. This coefficient can be used to calculate the change in length which can be expected when the humidity changes to a fixed level.

Using the following described method and calculations, a coefficient of humidity expansion was obtained for each individual coating tested.

A composite shim, made of 1) steel and 2) the coating material was used in the test to obtain the data for calculating the coefficient of humidity expansion. Steel was selected as the substrate for the coating because 1) the steel does not change with relative humidity, 2) the coatings do not seep into the steel, and 3) the steel is unaffected by the heating/drying process used to cure the coatings.

To find the coefficient for each coating material a composite shim was prepared which had the coating material covering one side of a steel shim which measured 6 inches× 0.5 inches.

Sample Preparation

Since most of the coatings do not wet out evenly on the steel shim surface, the surface of the shim is prepared so that it can be coated evenly. Shim surfaces were prepared by either sanding the surface with emery cloth or by etching it with nitric acid. Either of these methods can be used without effecting the result of the measurement. The thickness of the steel shims used in these tests measured approximately 5 mils thick after surface treatment.

The coatings were sprayed onto the steel surface of one side of the shim. Separate layers were sprayed, and then each layer was dried in an oven (at 300° F.) for about 30 seconds to obtain tack before applying the next layer. After a thickness of approximately 8–10 mils was achieved, the shim samples were put back into the oven for final curing. Each coating was on one side only.

After coating, the samples were cooled and stored in a desiccator until they were tested for the data measurements.

When the cured coating is on the steel shim under dessicator conditions (zero percent humidity), the shim will be straight, showing no curve at all. If, however, the composite is exposed to an environment having a higher humidity, the coating will experience a change in length which can be either positive (an increase or a "humidity growth") or negative (a decrease or a "humidity shrinking").

This change in length will make the shim bend as the humidity increases. If the change is a humidity growth, the coating on the shim will get longer, causing the shim to curve (the shim will bend away from the coating). In the case of humidity growth, the coating will be in a convex shape, the shim having its outer, curved surface coated. In the case of humidity shrinking, the coating will have a concave shape, the shim having the steel side as its outer, curved surface, and the coated side would be the inner, curved (concave) surface; here, the shim will bend toward the coating.

The curvature of the shim can be used to calculate the humidity expansion coefficient of the coating layer. Each shim curves in humidity, and the curve is an arc from a circle. Using measurements of the X and Y coordinates of arc, the radius of curvature and center point coordinates are found.

Sample Measurement and Determination of the Coefficient

The shims were separately removed from the dessicator and were placed in an atmosphere held to 85° F. under the controlled humidities of 45, 75, 90, and 95. Each shim was placed in a holder so that the 0.5 inch dimension was perpendicular to the ground. This minimizes deflections due to gravity.

After the shim had adjusted to the humidity change, the X and Y coordinates of the shim edge was recorded at every 5 millimeter increment along the long dimension of the shim beginning at the bottom where the shim was secured.

The digitized shim positions were entered into a data table and plotted so that the scatter plots could be examined for any gross errors. The radius of curvature of the samples was then obtained using a nonlinear curve fitting alogrithm to fit the equation of a circle to the raw data points.

To generate the initial values, three data points (the two end points and one point from the middle) were used from the plotted data set on each coating, then the equation for the circle passing exactly through these points was obtained. (The computer program used to solve this problem was the TKSolver program named PT3CIRCL.)

This solution gave the center of the circle and the radius. These values were then used to solve an alogrithm to determine the humidity expansion coefficient of one layer in a two layered composite beam. The other measurements required were thickness of the coating layer, elastic modulus of the coating, thickness of the shim, elastic modulus of the shim, and shim width. The computer program then used to solve the equation for humidity expansion coefficient was the TKSolver program named FAUPEL2.

The program solves the equations governing deflection in a two layered beam due to differential expansion in the layers.

In this alogrithm the only unknown is the humidity expansion coefficient of the coating. This value is back calculated.

Coating Data

Using the above described method, the coefficient of humidity expansion and elastic modulus (at 90% relative humidity) was determined for several coatings. The results are as follows:

TABLE 1

| Binder | Elastic Modulus[3] | Coefficient[4] |
|---|---|---|
| melamine formaldehyde[1] | 633,000 | 0.000023 |
| crosslinked epoxy[2] | 548,000 | 0.0000069 |
| starch | 109,000 | 0.0 |
| latex | 108,000 | 0.0 |

Footnotes:
[1]The mel/form coating was a melamine/formaldehyde resin binder which has a clay filler:binder ratio of 5:1. The melamine/formaldehyde resin binder was Aerotru 23 obtained from Cytek.
[2]The crosslinked epoxy coating (Epi-Rez 3551) was from Shell and had a clay filler/binder ratio of 5/1. The crosslinker was Cymel 303 (melamine formaldehyde) from Cytek.
[3]The elastic modulus is in pounds per square inch (of the coating cross-sectional area) and was taken at 90% relative humidity.
[4]The coefficient of humidity expansion is in inch/inch/1 percent of humidity.

EXAMPLES 1–3

Uncoated ceiling boards were obtained which were as identical as possible. The boards were made using the same process, had the same formulation, and were cut and sanded in identical processes to identical sizes.

For Example 3, as a control, the board was allowed to remain uncoated. For Example 1 the coated board was in accordance with the present invention. For Example 2, the board had a coating system (coatings on the front and back faces) which can be found on commercially available boards.

For Examples 1 and 2 the boards all had the identical coating composition on the back face of each board. This back coating (used as coating B in Example 1) was melamine-formaldehyde resin binder (Aerotru 23 from Cytek Corporation) with a filler/binder ratio of 5/1. This back coating on each board was approximately 2 mils thick. On the front face, in Examples 1 and 2, each board was given a prime coat (directly on the board) which was approximately 2 mils thick, and was also given a second coat (on the prime coat) approximately 2 mils thick. For Example 2, there was a third, top coat on the second coat which was a latex paint for cosmetic purposes as is typically used by the industry on commercial products. The coating type and location are indicated in the table below for all of Examples 1–3.

TABLE 2

| Example | Prime Coat | 2nd Coat | Top Coat | Back Coat |
|---|---|---|---|---|
| 1 | epoxy[1] | epoxy[1] | none | mel/form[2] |
| 2 | starch | starch | latex | mel/form[2] |
| 3 | none | none | none | none |

Footnotes for Table 2:
[1]The epoxy was a crosslinked epoxy coating (Epi-Rez 3551 from Shell and had a clay filler/binder ratio of 5/1. As can be seen under the above measurements of the coefficient and modulus of Table 1, this epoxy qualifies as a coating A of the foregoing description. The crosslinker was Cymel 303 (melamine-formaldehyde) from Cytek.
[2]The mel/form coating was a melamine/formaldehyde resin binder which has a clay filler:binder ratio of 5:1. The melamine/formaldehyde resin binder was Aerotru 23 obtained from Cytek. As can be seen above in the measurements of the coefficient and modulus of Table 1, this coating is suitable as a coating B of the foregoing description.

SAG TEST

Each board was tested for sag resistance according to the following described procedure. Each board was placed in a face down position and was supported on all four ends (all the way around the perimeter) of the face surface for a distance of 0.25 inches from each edge. The board being tested was then subjected to a relative humidity of 90% for 17 hours at 82° F. and then to a relative humidity of 35% for 6 hours also at 82° F. This exposure to 90% humidity followed by the 35% humidity period is, together, considered one cycle.

Each board was subjected to four cycles of this 90%/35% humidity. The sag was measured from the center of the board at the beginning of the first cycle (the initial reading below), and was also measured after exposure to 90% humidity, and after the 35% humidity period during the fourth cycle.

The results of the sag testing is given in Table 3.

TABLE 3

| Example Number | 4th Cycle Initial Sag | After 90% RH Exposure | After 35% RH Exposure |
|---|---|---|---|
| 1 | +20 mils | +98 mils | −20 mils |
| 2 | −110 mils | −148 mils | −164 mils |
| 3 | −338 mils | −454 mils | −478 mils |

The foregoing data in Table 3 shows that although some sag resistance is obtained (under Example 2) from the typical coatings, better sag resistance is obtained with the face coatings used in Example 1. As is shown in the tests for elastic modulus and the coefficient of humidity expansion, Example 1 has a coating system as described and required in accordance with the present invention and shows the best sag resistance. Example 2 lacks a front coating with a high enough modulus of elasticity on the front face. The failure of Example 2 to match the sag resistance demonstrates the need for both coating A and coating B.

EXAMPLES 4–9

Uncoated ceiling boards were obtained which were as identical as possible. The boards were made using the same process, had the same formulation, and were cut and sanded in identical processes to identical sizes.

For Example 9, as a control, the board had a coating system (includes coatings on both the front and back faces) which matches commercially available boards.

All of the boards for Examples 4–9 were given three coatings on the face (a prime coat, a second coat, and a top coat). The top coat used for all of the boards was ethylene vinyl chloride latex.

TABLE 4

| Example | Prime Coat | 2nd Coat | Top Coat | Back Coat |
|---|---|---|---|---|
| 4 | epoxy[1] | starch | latex | mel/form[2] |
| 5 | epoxy[1] | epoxy[1] | latex | mel/form[2] |
| 6 | starch | epoxy[1] | latex | mel/form[2] |
| 7 | starch | epoxy[1] | latex | none |
| 8 | starch | epoxy[1] | latex | epoxy[1] |
| 9 | starch | starch | latex | mel/form[2] |

Footnotes for Table 4:

[1]The epoxy coating was a crosslinked epoxy Epi-Rez from Shell. The crosslinker used was Cymel 303 a melamine formaldehyde from Cytek. As can be seen above in Table 1, this epoxy qualifies as a coating A of the foregoing description.

[2]The mel/form coating was a melamine/formaldehyde resin binder which has a clay filler:binder ratio of 5:1. The melamine/formaldehyde resin binder was Aerotru 23 obtained from Cytek. As can be seen from the above measurements under Table 1, this coating qualifies as a coating B of the foregoing description.

The boards were tested for sag resistance using the same testing procedure that is described for Examples 1–3. The test data for Examples 4–9 is given below in Table

TABLE 5

| Example Number | 4th Cycle Initial sag | After 90% RH Exposure | After 35% RH Exposure |
|---|---|---|---|
| 4 | −117 mils | −78 mils | −133 mils |
| 5 | −48 mils | +46 mils | −53 mils |
| 6 | −14 mils | −43 mils | −28 mils |
| 7 | −190 mils | −90 mils | −216 mils |
| 8 | −164 mils | −168 mils | −181 miis |
| 9 | −149 mils | −163 mils | −168 mils |

Here, the success of Examples 5 and 6 over Example 4 confirm that it is preferred to have the epoxy (coating A) as the second coat on the board (put on a prime coat on the board) because the board delivers better sag resistance than it would if coating A were the prime (first) coat on the board (compare to Example 4). Example 5 confirms that it is most preferred to have coating A as both a prime (first) coat and the second coat on the board.

We claim:

1. A sag-resistant ceiling board comprises a ceiling board having a front face and having a back face wherein the ceiling board has a coating system which includes coating A on the front face wherein coating A has an elastic modulus of at least about 400,000 pounds per square inch of coating at relative humidities in the range of from about 90 to about 100% and the board further has coating B on the back face wherein coating B has an elastic modulus of at least about 400,000 pounds per square inch of coating at relative humidities in the range of from about 90 to about 100% and further has a higher coefficient of humidity expansion than any coating on the front face of the ceiling board, further providing that on the front face there is no coating which has both a) an elastic modulus value of at least about 250,000 pounds per square inch or more and b) a coefficient of humidity expansion that is equal to or greater than the coefficient of humidity expansion of coating B.

2. The sag-resistant ceiling board of claim 1 wherein coating A and coating B have a thickness in the range of from about 2 to about 8 mils.

3. The sag-resistant ceiling board of claim 1 wherein coating A is a crosslinked epoxy having a filler/binder ratio of a maximum of about 7/1.

4. The sag-resistant ceiling board of claim 1 wherein coating B is a melamine formaldehyde having a filler/binder ratio of a maximum of about 7/1.

5. The sag-resistant ceiling board of claim 1 wherein coating A and coating B have a minimum thickness of at least about 1 mil.

6. The sag-resistant ceiling board of claim 1 wherein coating A is a second coat.

7. A method for the preparation of a sag-resistant ceiling board, said board having a front face and a back face, comprising:

(a) coating the front face with coating A which has an elastic modulus of at least about 400,000 pounds per square inch of coating at relative humidities in the range of from about 90 to about 100%, and (b) coating the back face with coating B which has an elastic modulus of at least about 400,000 pounds per square inch of coating at relative humidities in the range of from about 90 to about 100% and further has a higher coefficient of humidity expansion than any coating on the front face of the ceiling board.

8. The method of claim 7 wherein coating A and coating B have a thickness in the range of from about 2 to about 8 mils.

9. The method of claim 7 wherein coating A is a crosslinked epoxy having a filler/binder ratio of a maximum of about 7/1.

10. The method of claim 7 wherein coating B is a melamine formaldehyde having a filler/binder ratio of a maximum of about 7/1.

11. The method of claim 7 wherein coating A and coating B have a minimum thickness of at least about 1 mil.

12. The method of claim 7 wherein coating A is put on as a second coat.

* * * * *